United States Patent [19]

Ogawa et al.

[11] 3,969,785

[45] July 20, 1976

[54] RESIDUAL TONER REMOVING APPARATUS

[75] Inventors: Masaya Ogawa, Sakai; Tetsuhisa Furukawa, Toyokawa, both of Japan

[73] Assignee: Minolta Camera Kabushiki Kaisha, Osaka, Japan

[22] Filed: Apr. 22, 1974

[21] Appl. No.: 463,177

[30] Foreign Application Priority Data

May 8, 1973 Japan ..... 48-53769[U]

[52] U.S. Cl. ..... 15/301; 15/256.51; 355/15

[51] Int. Cl.[2] ..... A47L 5/38; G03G 21/00

[58] Field of Search ..... 355/15; 15/1.5, 256.51, 15/256.53, 301, 308, 383; 55/486, DIG. 13, DIG. 16

[56] References Cited

UNITED STATES PATENTS

| | | | |
|---|---|---|---|
| 2,751,616 | 6/1956 | Turner et al. | 15/1.5 |
| 3,410,060 | 11/1968 | Reilly et al. | 355/15 UX |
| 3,483,679 | 12/1969 | Balbierer | 355/15 UX |
| 3,534,427 | 10/1970 | Severynse | 15/1.5 X |
| 3,741,157 | 6/1973 | Krause | 355/15 UX |
| 3,795,025 | 3/1974 | Sadamitsu | 15/256.52 |
| 3,804,943 | 4/1974 | Block | 55/DIG. 16 X |

*Primary Examiner*—Fred L. Braun
*Attorney, Agent, or Firm*—Wenderoth, Lind & Ponack

[57] ABSTRACT

A residual toner removing apparatus which generally comprises four sections communicating with one another, i.e., a cleaner section including a cleaner brush rotatably provided in a housing which has an opening adjacent to a photoreceptor surface, and a duct section which extends from the above housing to a filter section which is in turn followed by a suction section having a fan. Toner particles removed from the photoreceptor surface by the cleaner brush are dislodged from the brush bristles upon contact with a flicker rod to which an air flow regulating plate is fixed and efficiently carried by air flows, through proper gaps, air passages or a slit, into the filter section in which a filter is enclosed.

9 Claims, 4 Drawing Figures

RESIDUAL TONER REMOVING APPARATUS

BACKGROUND OF THE INVENTION

The present invention relates to a residual toner removing apparatus, and more particularly to a residual toner removing apparatus for use in an electrostatic copying machine.

According to a conventional residual toner removing apparatus, the elimination of toner particles remaining on a photoreceptor surface after transferring a toner powder image to a copy paper sheet is carried out by wiping the residual toner particles off the photoreceptor surface with a rotatable cleaner brush after the photoreceptor surface is electrically neutralized by an A.C. discharger. Although the residual toner particles may be approximately completely removed from the photoreceptor surface by the above method, toner particles adhering to the brush bristles of the cleaner brush can not be sufficiently removed and collected by a mere suction device, such as a fan, the amount of toner powder adhering to the bristles gradually increasing in the course of time with reduction of cleaning effect and durability of the cleaner brush itself.

In the conventional residual toner removing apparatus of the above construction, brush bristles of the cleaner brush are adapted to strike against a flicker rod provided in a path of the brush bristles as the cleaner brush rotates so as to shake loose toner particles adhering to the bristles and carry the dislodged toner particles by air flows produced by a suction device into a filter bag. However, the conventional apparatus of the above described type have such disadvantages that, when the brush bristles beat on the flicker rod, vortices of air tend to occur at the back of the flicker rod, causing the detached toner particles to stick to the brush bristles again.

Furthermore, a small space provided between the tips of brush bristles and the lower brush casing causes toner particles to accumulate on the surface of such casing and to scatter about when the cleaner brush is removed for maintenance or inspection of the apparatus. Since the dislodged toner particles floating in the air at the back of flicker rod are electrically charged due to friction, such particles are electrostatically attracted toward the bottom surface of the duct section connected to the filter section, resulting in reduced efficiency for toner removing.

SUMMARY OF THE INVENTION

Accordingly, an essential object of the present invention is to provide a residual toner removing apparatus which provides efficient removal of residual toner particles with subsequent elimination of the disadvantages inherent in the conventional residual toner removing devices.

Another important object of the present invention is to provide a residual toner removing apparatus of the above described type having means to direct the air entrained, dislodged toner particles efficiently into the filter section without scattering about or re-adhering to the brush bristles.

A further object of the present invention is to provide a residual toner removing apparatus of the above described type that is simple in construction and easy to maintain.

A still further object of the present invention is to provide a residual toner removing apparatus of the above described type which is provided with an efficient and durable filter means.

According to a preferred embodiment of the present invention, the residual toner removing apparatus generally comprises four sections in communication with one another, i.e. a cleaner section including a cleaner brush rotatably provided in a housing, and a duct section extending from such housing into a filter section which is followed by a suction section equipped with a fan.

In the cleaner section having an opening adjacent to the photoreceptor surface, the cleaner brush drum with brush bristles secured to the entire outer periphery thereof is adapted to rotate between an upper casing and a lower casing. Between the rear edges of the above casings facing the duct section, a flicker rod having an air flow regulating plate is provided in the path of the brush bristles. Toner particles wiped off the photoreceptor surface by the brush bristles and adhering to the bristles are dislodged from the brush bristles when the latter beat on the flicker rod as the cleaner brush rotates and are efficiently carried into the filter section by an air flow the direction of which is regulated by the above regulating plate without scattering around the back of the flicker rod or re-adhering to the brush bristles.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Before the description of the present invention proceeds, it should be noted that like parts are designated by like numerals throughout the views of the accompanying drawings.

Figure 1:
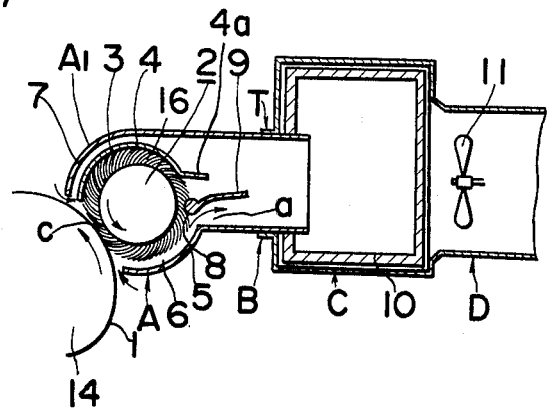
FIG. 1 is a schematic cross-sectional view of a residual toner removing apparatus according to a first embodiment of the present invention.
Figure 2:
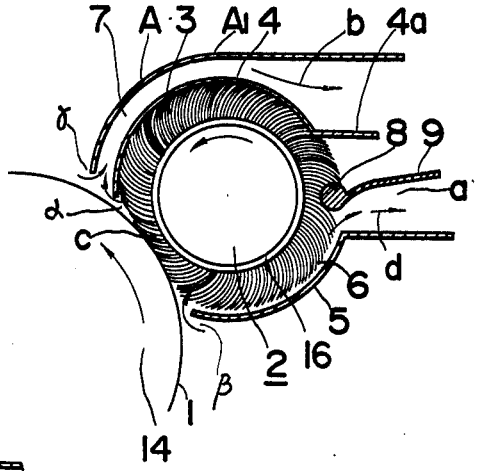
FIG. 2 is a similar view to FIG. 1 but showing an essential portion in enlarged scale.

Referring to FIGS. 1 and 2, the residual toner removing apparatus T of the present invention which extends across the width of a known photoreceptor 1 of an electrostatic copying machine generally comprises four sections A, B, C and D communicating with one another, a cleaner section A including a cleaner brush 2 rotatably provided in a housing A1, and a duct section B extending from housing A1 into a filter section C which is followed by a suction section D.

A roller 14 provided in a copying machine for the transport of a known photosensitive photoreceptor 1 is driven by a conventional means. Rotation of the rollers 14 (counterclockwise in the drawing) moves the photoreceptor 1, for example, in the form of an endless belt or a drum through various processing stations. After completion of transfer of an image of an original onto a copy paper sheet, the portion of the photoreceptor surface 1 bearing the toner powder image thereon through charging, exposure and developing processes is further carried on the roller 14 to a position facing the cleaning brush 2 for removing the residual toner particles from the photoreceptor surface 1. These and other processes are effected in a known manner in the copying apparatus, apart from the provision of the residual toner removing apparatus of the invention.

In the cleaner section A, the bottom portion of the housing A1 is formed into a concave lower casing 5 in the form of a trough for the cleaner brush 2. A small gap $\beta$ is formed between the front edge of the lower casing 5 and the photoreceptor surface 1, while the other edge of the casing 5 is bent horizontally to form a bottom portion of the duct section B. A drum 16 for the cleaner brush 2 with brush bristles 3 of animal fur such as rabbit fur or synthetic fur secured to the entire outer surface thereof is rotatably supported over the lower casing 5 by suitable means. Above the cleaner brush 2, there is fixedly provided an upper casing plate 4 which is electrically insulated from the lower casing 5 and divides the cleaner section A into two portions, i.e., the portion in which the cleaner brush 2 is enclosed and the air passage 7 formed between the upper casing 4 and the cleaner section housing A1. The front edge of the casing 5 is spaced away from the photoreceptor surface 1 to a certain extent to provide a small gap $\alpha$ therebetween while the rear lower part of the casing 4 is connected to a short flat portion 4*a* extending horizontally into the duct section B. The tips of the brush bristles 3 are adapted to rub against the inner concave face of the upper casing 4, keeping a fixed distance from the inner face of the lower casing 5 to form an air passage 6 during rotation, while applying very slight pressure to the photoreceptor surface 1 at a contact gap C formed between front edges of the casings 4 and 5. There is also provided a small gap $\gamma$ between the upper front edge of the cleaner section housing A1 and the photoreceptor surface 1. A flicker rod 8, which extends across the width of the housing A1, and is fixedly supported in the housing side walls, not shown, is located in a path of brush bristles 3 between the flat rear portion 4*a* of the casing 4 and the rear portion of the lower casing 5 leading to the duct section B, while an air flow regulating plate 9 which also extends across the width of the flicker rod 8 is fixedly attached to the rod 8, extending approximately horizontally, with its rear free edge slightly raised upward, from the rod 8 to a middle portion of duct section B, thus forming an air passage a between the plate 9 and the bottom portion of the duct section B.

The end portion of the duct section B remote from the cleaner section housing A1 projects into the filter section C of a box shape to a certain extent through a corresponding opening formed in the filter housing C and tightly connected to a mouth of a filter bag 10 contained in the filter housing C which is followed by a suction section D, having a fan 11, for example, a silocco fan therein.

Operation of the abovedescribed apparatus is as follows. The portion of the photoreceptor surface 1, the toner powder image on which has been transferred onto a copy paper sheet, and to the surface of which there are still attached remnant toner particles, is brought by the roller 14, which rotates counterclockwise at a moderate speed, into the contact gap C of the residual toner removing apparatus, and is there contacted by the brush bristles 3 of the cleaner brush 2 which is also rotated counterclockwise, but at a higher speed. The remnant toner particles are thus wiped off the surface of the photoreceptor surface 1. Simultaneous rotation of the fan 11 draws air through the gap $\beta$ into the space 6, causing an air flow in the direction of an arrow *d*. In the mean time, toner particles adhering to the brush bristles 3 are detached from the bristles 3 when the latter strikes against the flicker rod 8, and are carried by the above air flow through the gap $\beta$, space 6 and the air passage *a* into the filter bag 10 in the filter section C.

It should be noted that the air flow regulating plate 9 fixed to the flicker rod 8 is particularly effective in directing the air flow containing the toner particles in the direction of the arrow *d* and sending the same efficiently into the filter bag 10 in cooperation with the suction by the fan 11.

Furthermore, since the above air flow regulating plate 9 also acts as a wind direction shifting plate and a partition, no air vortex is caused at the back of the flicker rod 8 and the toner particles are effectively carried in the direction of the arrow *a* without scattering thereabout or re-adhering to the brush bristles 3.

Toner particles still remain on the brush bristles 3 even after the bristles 3 have struck against the rod 8 are discharged through the gap $\alpha$ into the passage 7 as the cleaner brush 2 rotates and are drawn in the direction shown by an arrow *b* by the air flow caused by the fan 11 into the filter bag 10 in the filter section C. Since air is also drawn into the passage 7 in the direction of the arrow *b* through the gap $\gamma$ by the action of the fan 11, the toner particles discharged into the passage 7 through the gap $\alpha$ never scatter out of the apparatus through the gap $\gamma$. The brush bristles 3, from which the toner particles have almost completely been removed in the above manner, again contact the photoreceptor surface 1, repeating the same procedure as described above.

In the above embodiment, the air flow regulating plate 9 is not necessarily a separate element from the flicker rod 8, but may be in integral connection with the flicker rod 8, for example, the flicker rod 8 may be formed from a sheet of metal by rounding one edge thereof to make the rod 8 and plate 9 integral. Similarly, the lower casing 5 may be separately formed and connected to the bottom portion of the duct section B.

Figure 3:
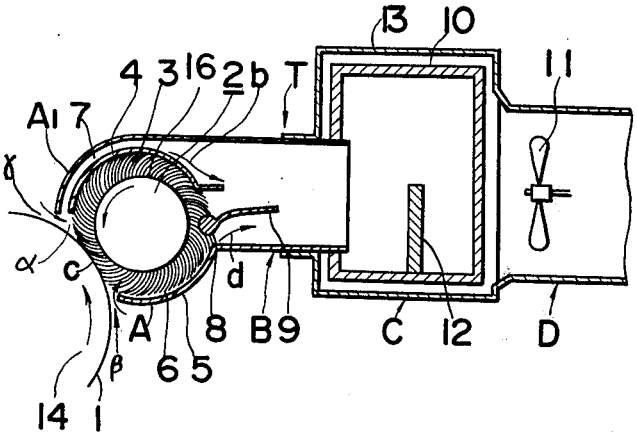
FIG. 3 is a schematic cross-sectional view of a second embodiment of the residual toner removing apparatus of the invention.

Referring to FIG. 3, there is shown a second embodiment of the present invention. In this embodiment although the construction of the apparatus is similar to that in the first embodiment, the filter bag 10 is enclosed in the filter housing 13 in spaced relation to the latter to keep some space therebetween by means of a plurality of spacers (not shown) suitably provided at several places between the inner surface of the filter housing 13 and the outer surface of the bag 10, so that the air is drawn uniformly from the entire surface of the filter bag 10 by the action of the fan 11. Furthermore, a baffle plate 12 made of suitable material such as a cardboard or the like is fixedly provided on the bottom surface of the filter bag 10 so that the air entrained toner particles regulated by the air flow regulating plate 9 collide with the baffle plate 12. In FIG. 3, the baffle plate 12 extends upwardly, approximately half way in filter section C, at right angles from the bottom portion of filter bag 10, with one surface of the plate 12 facing the cleaner brush 2 through the duct section B in parallel to the axis of the brush 2.

In this second embodiment, the air entrained toner particles dislodged from the brush bristles 3 when the bristles 3 strike against the flicker rod 8 are directed in the direction of the arrow *d* as the direction of the air flow is regulated by the plate 9 and effectively sucked into the filter bag 10, assisted by the suction force of the fan 11 as in the first embodiment. In this case, most of the toner particles hitting the baffle plate 12 provided in the bag 10 fall and accumulate in front of the plate 12 with a small amount of toner powder still remaining in the air flow being sucked in the entire surface of the bag 10 by the action of the fan 11, by which method the filter bag 10 is soiled only partially with little clogging thereof, resulting in extremely long life of the filter bag 10 (According to experiment, the durability of the filter bag increased by two to five times as compared with a system without the baffle plate).

Other functions of the apparatus in the above second embodiment of FIG. 3 are exactly the same as those in the first embodiment of FIG. 1, so that other descriptions are abbreviated for brevity.

In the above second embodiment of the invention, in addition to the effect of the above flicker rod provided with the regulating plate, as the filter bag is enclosed in spaced relation in the filter housing with a baffle plate provided within the filter bag, most of the removed toner particles fall and accumulate in front of the baffle plate with little possibility of the clogging of the entire filter screen, thus resulting in a prolonged optimum filtering efficiency and a small size of the filter bag.

Figure 4:
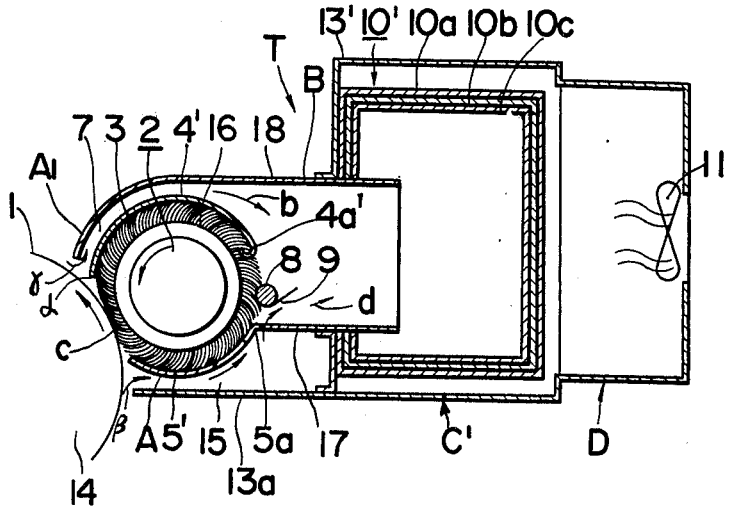
FIG. 4 is a schematic cross-sectional view of a toner removing apparatus according to a third embodiment of the present invention.

Reference is now made to a third embodiment of the invention shown in FIG. 4. In this third embodiment, the apparatus T which extends across the width of the photoreceptor 1 comprises four sections in communication with one another in a manner similar to those in the first embodiment, a cleaner section A including a rotatable cleaner brush 2 in a housing A1, and a duct section B extending from housing A1 into a filter section C which is followed by a suction section D.

In the cleaner section A, the housing A1 is provided with a contact gap *c* facing the photoreceptor surface 1 and includes a concave lower casing 5′ and an upper casing 4′ both having semi-circular cross sections, between which a drum 16 for the cleaner brush 2 with brush bristles 3 of animal fur such as rabbit fur or synthetic fur attached to the entire outer periphery thereof is rotatably supported by suitable means. The brush 2 is adapted to rotate counterclockwise in the direction of the arrow i.e., in the same direction as the photoreceptor drum 14, with tips of the brush bristles 3 contacting inner concave faces of both the upper casing 4′ and the lower casing 5′.

A small gap $\alpha$ is provided between the front edge of the upper casing 4′ and the photoreceptor surface 1, while the rear lower edge of the casing 4′ is rounded inwardly into the path of the brush bristles 3 to assist in the action of a flicker rod 8. The front edge of the top wall of the cleaner section housing A1 is somewhat spaced away from the photoreceptor surface 1 to form a small gap $\gamma$ therebetween with an air passage 7 formed between the upper face of the casing 4′ and the inner face of the top wall of the housing A1. The front edge of the lower casing 5′ is also spaced away from the photoreceptor surface 1 to a certain extent to form a small gap therebetween. A slit 5*a* extending across the width of the lower casing 5′ is formed in the direction parallel to the axis of the brush 2 at the junction of the rear edge of the lower casing 5′ and a bottom portion 17 of the duct section B.

A flicker rod 8 extending across the width of the housing A1 and fixedly supported in the housing side walls, not shown, is provided in a path of the brush bristles 3 between the rounded rear edge 4*a*′ of the casing 4′ and the above mentioned slit 5*a*. The flicker rod 8 is provided with an air flow regulating plate 9 in exactly the same manner as in the first embodiment, whose description is abbreviated for brevity.

The end portion of the duct section B formed with top and bottom walls 18 and 17 and side walls extending from the cleaner section housing A1 projects through corresponding openings formed in the filter housing 13′ and filter bag 10′, into the filter bag 10′ enclosed in the filter section C to a certain extent and tightly connected to the opening of the filter bag 10′.

The bottom portion 13*a* of the filter section housing 13′ extends forward close to the photoreceptor surface 1. A small gap $\beta$ is provided between the photoreceptor surface 1 and the front edge of the extended bottom portion 13*a*, and an air passage 15 is formed between the upper surface of the extended bottom portion 13*a* and the under surface of the lower casing 5′. The filter bag 10′ is enclosed in the filter housing 13′ in spaced relation to the latter in a manner similar to that in the first embodiment and comprises three layers 10*a*, 10*b* and 10*c* with the outer layers tighter in filter screen texture than inner layers, i.e., the outermost layer 10*a* which is made of non-woven fabrics, for example, of acetate or polypropylene is the tightest in meshes, followed by the intermediate layer 10*b* and innermost layer 10*c* of urethane foam of sponge state which are coarser in screen meshes.

The filter section C is followed by a suction section D in which a fan 11, for example, a silicco fan is provided for causing air flow through the apparatus.

By this arrangement, when the cleaner brush 2 is rotated counterclockwise, in the same direction as the drum 14 for the photoreceptor 1 with the fan 11 rotating, the brush bristles 3 of the cleaner brush 2 wipe the residual toner particles off the photoreceptor surface 1, while air is sucked in through the gaps $\beta$ and $\gamma$ and flows through the passages 7 and 15.

Since the tips of the brush bristles 3 rub against the inner surface of the casing 5′ in this third embodiment, the toner particles removed from the photoreceptor surface 1 are safely carried by the brush bristles 3 as the cleaner brush 2 rotates, and dislodged from the bristles 3 as the latter strike against the flicker rod 8 and the rounded portion 4*a*′ of the upper casing 4′. In this state, although the dislodged toner particles are charged by friction and tend to be attracted by the bottom portion 17 of the duct section B, the air flow through the split 5*a* whose direction of flow is regulated by the regulating plate 9 as shown by the arrow *d* advantageously carries the dislodged toner particles into the filter section C, most of the toner particles falling on the bottom portion of the filter bag 10′. Any toner particles still floating in the air are attracted onto the entire surface of the filter bag 10′ by the suction force of the fan 11.

Since the air flow regulating plate 9 serves as a wind direction shifting plate as well as a partition, no vortex is caused at the back of the flicker rod 8, the toner particles being effectively carried in the direction of the arrow *a* without scattering thereabout. Toner particles still adhering to the brush bristles 3 are again shaken off the bristles 3 as the latter strike against the rounded portion 4*a*′ of the upper casing 4′ and carried by the air flow in the direction of the arrow *b*′ into the filter bag 10′ together with the toner particles dislodged by the above flicker rod 8. The round portion 4*a*′ at the rear edge of the upper casing plate 4′ not only serves as an additional flicker rod as above, but also is effective for preventing the removed toner particles from entering between the cleaner brush 2 and the upper casing 4′ by limiting the space therebetween.

Toner particles still adhering to the brush bristles 3 even after the latter have struck against the flicker rod 8 are discharged through the gap $\alpha$ and carried by the air flow in the direction of the arrow *b* through the passage 7 as the cleaner brush 2 rotates without scattering out of the gap $\gamma$.

The baffle plate 12 in the filter bag 10 described as effected in the second embodiment may be employed in this embodiment to also increase the efficiency of the apparatus.

In the third embodiment of the present invention, as the brush bristles of the cleaner brush are adapted to rub against the inner surface of both upper and lower casings, no toner particles adhere to the inner surfaces thereof, and even when the cleaner brush is removed, for example, in the case of maintenance or inspection of the apparatus, there is little possibility of toner particles scattering about or causing soiling.

Since the rear end portion of the upper casing is rounded inwardly toward the path of the brush bristles, toner particles still adhering to the bristles after the latter have struck against the flicker rod during rotation are efficiently removed, and at the same time the device is very effective in preventing the toner particles dislodged by the flicker rod from adhering to the photoreceptor surface again.

The provision of the slit at the junction of the lower casing and the bottom portion of the filter housing is also very effective, since toner particles dislodged from the brush bristles by the flicker rod are carried forcibly into the filter section by the air flow through the slit, the direction of such flow being regulated by the regulating plate attached to the flicker rod without any toner particles accumulating on the bottom portion of the duct section. Since the slit is formed close to the rear edge of the lower casing, the decreased contact area between the casing and the brush bristles and the "air knife" effect of the air flow through the slit, result in less damage to brush bristles with durability of the bristles increased by approximately two to three times as compared with a system without any slit.

Furthermore, as the filter bag is enclosed in the filter housing in spaced relation to the latter with the filter bag composed of three layers having tight and coarse screen texture, the toner particles are attracted to the entire surface of the filter bag according to the sizes of toner particles, with little clogging of the filter screen for a long period of time. According to an experiment, the time required to render the filter screen of such multilayers clogged is longer than that for a single layer filter screen by 2000 to 4000 hours.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. In a residual toner removing apparatus for use in cleaning a photoreceptor surface of an electrostatic copying machine, said apparatus being of the type including a cleaner section including a housing and a cleaner brush rotatably provided within said housing, said housing having an opening, said cleaner brush extending through said opening so that it is engageable with a photoreceptor surface to be cleaned, and said cleaner section further having a first semi-circular concave casing partially enclosing said cleaner brush, said first casing extending away from said opening into said housing, and a duct section extending from said cleaner section housing, a filter section housing having a filtering member therein and coupled to said duct section and a suction section coupled to said filter section;

the improvement including means for removing toner particles from a photoreceptor surface and said cleaner brush and comprising:

a semi-circular concave second casing forming a portion of said cleaner section housing opening and leading to said duct section and partially enclosing said cleaner brush, said first casing contacting at an inner face thereof bristles of said cleaner brush, an air passage formed between said cleaner section housing and said first casing, a rear portion of said first casing and a rear portion of said second casing leading to said duct section and forming a duct opening;

a flicker member positioned substitutially centrally of said duct opening, said flicker member being positioned to contact said bristles of such cleaner brush during rotation of said brush; and an air flow regulating plate means, fixed to said flicker member and extending from said flicker member substantially centrally of said duct section toward said filter section housing, for preventing the formation of air vortices at the back of said flicker member, there being open communication through said duct opening between said cleaner brush and said duct section both above and below said plate means;

the toner particles removed from said cleaning brush thereby being prevented from becoming reattached to said brush.

2. A residual toner removing apparatus as claimed in claim 1 wherein said rear portion of said first casing is bent to extend to a certain extent into said duct section above said flicker member.

3. A residual toner removing apparatus as claimed in claim 1, further comprising a plurality of spacers, said filtering member being enclosed in said filter section housing in spaced relation to the latter by said plurality of spacers.

4. A residual toner removing apparatus as claimed in claim 1 wherein said flicker member is a flicker rod, said air flow regulating plate means being integrally formed with said flicker rod.

5. A residual toner removing apparatus as claimed in claim 1 wherein said second casing is separately formed and connected to said duct section.

6. In a residual toner removing apparatus for use in cleaning a photoreceptor surface of an electrostatic copying machine, said apparatus being of the type including a cleaner section including a housing and a cleaner brush rotatably provided within said housing, said housing having an opening, said cleaner brush extending through said opening so that it is engageable with a photoreceptor surface to be cleaned, and said cleaner section further having a first semi-circular concave casing partially enclosing said cleaner brush, said first casing extending away from said opening into said housing, and a duct section extending from said cleaner section housing, a filter section housing having a filtering member therein and coupled to said duct section and a suction section coupled to said filter section;

the improvement including means for removing toner particles from a photoreceptor surface and said cleaner brush and comprising:

a semi-circular concave second casing forming a portion of said cleaner section housing opening and leading to said duct section and partially enclosing said cleaner brush, said first casing contacting at an inner surface thereof bristles of said cleaner brush, an air passage formed between said cleaner section housing and said first casing, a rear portion of said first casing and a rear portion of said second casing leading to said duct section and forming a duct opening;

a flicker member positioned substantially centrally of said duct opening, siad flicker member being positioned to contact said bristles of said cleaner brush during rotation of said brush; and an air flow regulating plate means, fixed to said flicker member and extending from said flicker member substantially centrally of said duct section toward said filter section housing, for preventing the formation of air vortices, at the back of said flicker member;

said filtering member comprising a filter bag, and a baffle plate extending upwardly at right angles from approximately a mid length position of a bottom portion of said filter bag, said baffle plate being fixedly provided facing said cleaner brush and extending parallel to the axis of said cleaner brush;

the toner particles removed from said cleaning brush thereby being prevented from becoming reattached to said brush.

7. A residual toner removing apparatus as claimed in claim 6 wherein said baffle plate is integrally formed with said filter bag.

8. In a residual toner removing apparatus for use in an electrostatic copying machine, said apparatus being of the type including a cleaner section including a housing and a cleaner brush rotatably provided within said housing, said housing having an opening, said cleaner brush extending through said opening so that it is engageable with a photoreceptor surface to be cleaned, and said cleaner section further having a semicircular concave upper casing partially enclosing said cleaner brush, said upper casing extending away from said opening into said housing, and a duct section extending from said cleaner section housing, a filter section housing having a filtering member therein and coupled to said duct section and a suction section coupled to said filter section;

the improvement comprising means for removing toner particles from a photoreceptor surface and said cleaner brush and comprising:

a semi-circular concave lower casing forming a portion of said cleaner section housing opening and leading to said duct section and partially enclosing said cleaner brush, said upper casing contacting at an inner surface thereof bristles of said cleaner brush, an air passage formed between said cleaner section housing and said upper casing, a rear portion of said upper casing and a rear portion of said lower casing forming therebetween a duct opening, a rear end of said lower casing and a bottom portion of said duct section forming a slit for the passage therethrough of air, said slit extending across the width of said cleaner section housing;

a flicker member positioned substantially centrally of said duct opening, said flicker member being positioned to contact said bristles of said cleaner brush during rotation of said brush, said flicker member being positioned above said slit; and an air flow regulating plate means, fixed to said flicker member and extending from said flicker member substantially centrally of said duct section toward said filter section housing, for preventing the formation of air vortices at the back of said flicker member;

the toner particles removed from said cleaning brush thereby being prevented from becoming reattached to said brush.

9. A residual toner removing apparatus as claimed in claim 8 wherein said cleaner section housing has a lower portion cooperating with said lower casing to form an air passage extending from a position adjacent said opening to said slit.

* * * * *